US007748168B2

(12) United States Patent
Ferrara

(10) Patent No.: US 7,748,168 B2
(45) Date of Patent: Jul. 6, 2010

(54) PANEL MOUNTING SYSTEM

(76) Inventor: Frank Ferrara, 10103 Kingshyre Way, Tampa, FL (US) 33647

( * ) Notice: Subject to any disclaimer, the term of this patent is extended or adjusted under 35 U.S.C. 154(b) by 584 days.

(21) Appl. No.: 11/271,337

(22) Filed: Nov. 12, 2005

(65) Prior Publication Data

US 2007/0107329 A1 May 17, 2007

(51) Int. Cl.
*E06B 3/68* (2006.01)

(52) U.S. Cl. ..... 49/463; 49/55; 52/202

(58) Field of Classification Search ..... 49/50, 49/55–57, 463–465; 52/202, 203
See application file for complete search history.

(56) References Cited

U.S. PATENT DOCUMENTS

| | | | | |
|---|---|---|---|---|
| 2,777,174 | A * | 1/1957 | Carr | 49/465 |
| 5,131,186 | A * | 7/1992 | Lamont | 49/57 |
| 5,446,996 | A * | 9/1995 | Lamont | 49/57 |
| 5,673,883 | A * | 10/1997 | Figueroa, Jr. | 248/200.1 |
| 5,685,112 | A * | 11/1997 | Fara | 52/202 |
| 6,330,768 | B1 * | 12/2001 | Rodrigues | 52/202 |
| 6,371,422 | B1 * | 4/2002 | St. Martin et al. | 248/200.1 |
| 6,474,035 | B1 * | 11/2002 | Fara | 52/506.05 |
| 2002/0011316 | A1 * | 1/2002 | Whittemore | 160/368.1 |

* cited by examiner

*Primary Examiner*—Katherine W Mitchell
*Assistant Examiner*—Michael J Keller
(74) *Attorney, Agent, or Firm*—Arthur W. Fisher, III

(57) ABSTRACT

A panel mounting system to secure a protective panel to a building including a portal or window having a frame including an inner surface formed about the periphery thereof to receive and secure the panel mounting system thereto so that the protective panel covers the portal or window when the panel mounting system is secured in place, the panel mounting system comprising an elongated cross-bar including end portions formed on opposite ends thereof having a first securing assembly including a first panel attachment device formed thereon telescopingly coupled to one end portion of the elongated cross-bar by a first positioning assembly movable between a retracted position and an extended position and a second securing assembly including a second panel attachment device formed thereon telescopingly coupled to the other end portion of the elongated cross-bar by a second positioning assembly movable between an extended position and a retracted position such that the first securing assembly and the second securing assembly engage the inner surface of the frame on opposite sides of the portal or window when the first positioning assembly is moved from the retracted position to the extended position and the second positioning assembly is moved from the extended position to the retracted position when the first positioning assembly is moved from the retracted to the extended position, the first panel attachment device and the second attachment device configured to secure the protective panel to the panel mounting system when the panel mounting system is secured within the portal or window.

13 Claims, 4 Drawing Sheets

PANEL MOUNTING SYSTEM

BACKGROUND OF THE INVENTION

1. Field of the Invention

A panel mounting system to secure a protective panel to a building including a portal or window having a frame to receive and secure the panel mounting system therein so that the protective panel covers the portal when the panel mounting system is in place.

2. Description of the Prior Art

Hurricanes and high winds can cause substantial damage in many areas by breaking windows and glass doors. If a home or building is not equipped with storm shutters, many concerned homeowners purchase sheets of plywood to cover exterior windows and doors.

Generally, the plywood is nailed or screwed into the facing of the structure. Unfortunately, removal of the plywood and fasteners can result in damage to the face or exterior of the structure. Thus, various efforts have been made to secure protective means without damaging the building.

U.S. Pat. No. 5,937,593 relates to security closure secured over windows or other openings in a wall of a building in a manner to substantially prevent removal of the closure from the exterior of the building.

U.S. Pat. No. 6,308,462 shows a child safety barrier including a frame and a gate which can be swung from a closed position where the gate lies in the plane of the frame to an open position out of the plane. The gate includes an upper rod having a closing mechanism for locking the gate in a closed position or unlocking the gate to allow it to be opened. The closing mechanism includes a pivotable handle and a spring-loaded locking button which cooperates with the handle to retain it in a position wherein it locks the gate in a closed position.

U.S. Pat. No. 6,330,768 teaches a window protection comprising a rigid protective panel held securely in place by one or more innovative elongate braces or bars that extend from one wall of the window opening to an opposed wall. The brace has a long body provided with a planar friction pad at each end. Each pad is angularly adjustable relative to the long axis of the body to conform to the angle of the wall for maximum contact. One of the friction pads is connected to the body by a spring-loaded connection that allows for a short reciprocating motion with the spring urging the pad away from the body. This enables the user to temporarily hold the panel in place with one hand, while pushing the brace in place with both pads engaging opposed walls in a panel holding position with the other hand. The brace is then more tightly and securely extended by advancing a threaded nut that forces the pad farther away from the body.

U.S. Pat. No. 6,341,455 shows a protective cover assembly to cover and protect windows, doors or other wall openings from the destructive forces of a high windstorm such as a hurricane. The preferred embodiment comprises a high strength fabric covering the opening supported by brackets, a rod and a bar. Once installed, the high strength fabric is stretched over the opening through the use of a gears and ratchet assembly. The high strength fabric once stretched will provide protection from high winds and wind borne debris common in storms such as hurricanes.

U.S. Pat. No. 6,371,422 relates to a length adjustable bar for mounting within a window opening to secure a protective panel therein comprising a substantially hollow outer section having an inner section telescopingly received therein. A plurality of gear teeth are longitudinally disposed on the inner section. A cam is pivotally mounted to the outer section and includes gear teeth thereon that engage the gear teeth on the inner section when the cam is rotated to a first position. The cam is rotated with a handle having an aperture thereon that aligns with apertures on a pair of spaced tabs when the cam is placed in the first position to receive a locking means to fix the bar at a select length. The design allows the bar to be extended to substantially the same length or width of the window opening. By pivoting the handle downwardly, the geared cam extends the inner section slightly to tightly wedge the bar within the opening.

U.S. Pat. No. 6,640,509 discloses an adjustable length bracing device can be installed in a window frame or door frame to secure a sheet of covering material to protect the window or door from flying debris resulting from a hurricane, tornado, or other storm. The brace device comprises of two moveable bars which can be adjusted to fit the inside of a window or door opening. The adjustment is made by the use of a metal clip attached to one bar and inserted into a notch on the other bar. The ends of each bar have rubber pads to help prevent marring the window or door opening or frame and to prevent any slipping of the bracing device assembly. Once the assembly is in position, a locking metal ring holds both independent bars together to prevent movement.

US 2005/0016092 shows a brace assembly to hold a panel against a windowed building component to prevent property damage during a severe storm. The brace assembly includes a bar having a first and second end portion. The first end portion includes a plate having a threaded hole therein. The brace assembly further includes a threaded rod that is fastened to the threaded hole at one end and includes a foot plate at a second end. A turn handle extends through the threaded rod for facilitating rotation of the threaded rod. When the brace assembly is placed against a panel extending across a windowed building component, rotation of the threaded rod forces the foot plate and bar against opposing frame walls, thereby holding the panel in place.

Additional examples of the prior art are found in U.S. Pat. Nos. 4,492,263; 5,673,883; 6,263,625; Re. 17,911 and WO 90/14489.

SUMMARY OF THE INVENTION

The present invention relates to a panel mounting system to secure a protective panel to a building to protect a portal or window.

The panel mounting system comprises an elongated cross-bar including a first end portion and a second end portion formed on opposite ends thereof operatively coupled to a first securing assembly by a first positioning assembly and a second securing assembly by a second positioning assembly.

The first securing assembly comprises a first telescoping member having a first frame engaging base affixed to the outer end thereof to press-fit the panel mounting system in position within the frame of the portal or window. A first panel attachment device secures the protective panel to the first securing assembly.

The second securing assembly comprises a second telescoping member having a second frame engaging base affixed to the outer end thereof to press-fit the panel mounting system in position within the frame of the portal or window. A second panel attachment device secures the protective panel to the second securing assembly.

The first positioning assembly comprises a first cross-bar assembly section coupled to the first end portion of the elongated cross-bar and a first securing assembly section disposed to engage each other to selectively move the first positioning assembly between a retracted and an extended position. The second positioning assembly comprises a second cross-bar assembly section coupled to the second end portion of the elongated cross-bar and a second securing assembly section disposed to engage each other to selectively move the second positioning assembly from the extended position to the retracted position when the first positioning assembly is moved from the retracted position to the extended position to secure the panel mounting system to the inner surface of the frame.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the nature and object of the invention, reference should be had to the following detailed description taken in connection with the accompanying drawings in which.

Similar reference characters refer to similar parts throughout the several views of the drawings.

DETAILED DESCRIPTION OF THE INVENTION

Figure 1:
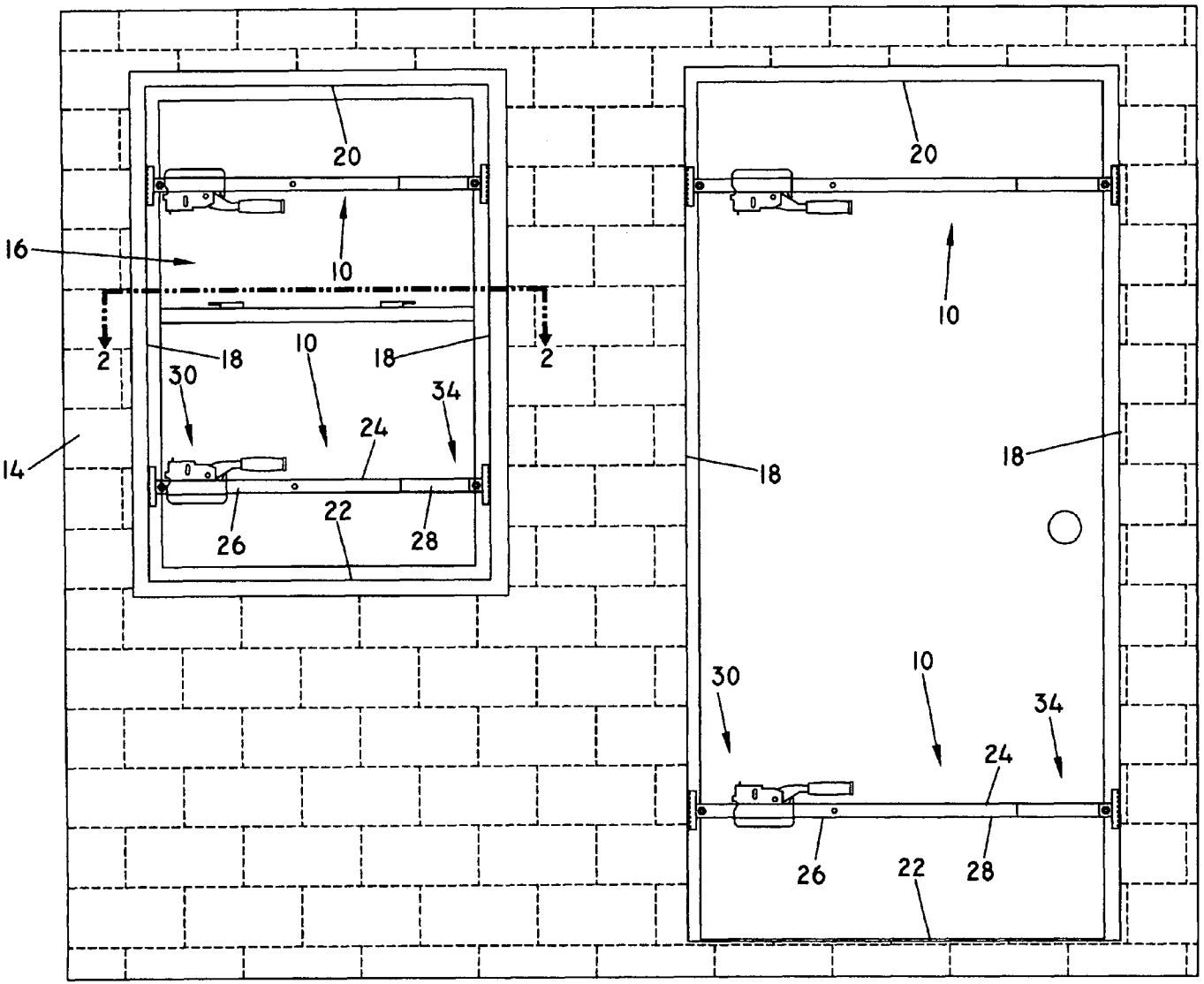
FIG. 1 is a front view of the panel mounting system of the present invention secured within the frame of a portal to be protected.
Figure 2:
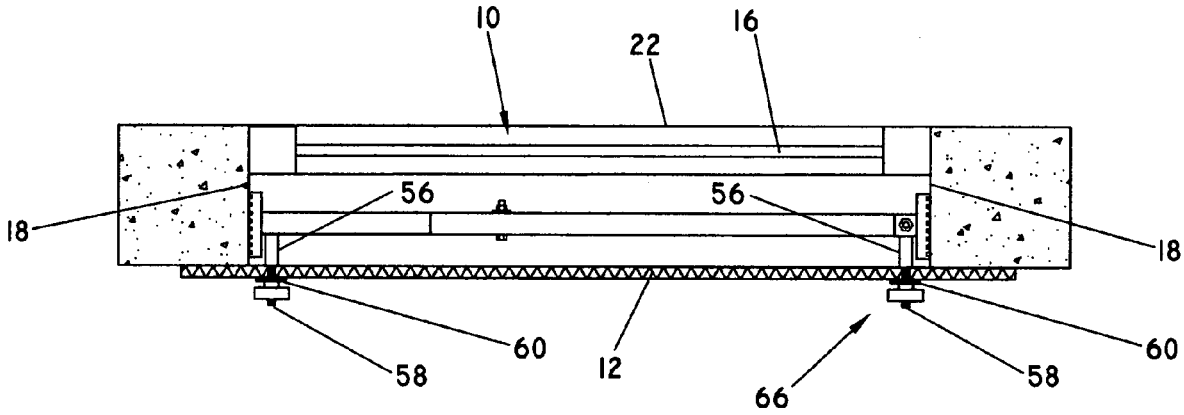
FIG. 2 is a cross-sectional view of the panel mounting system of the present invention in place securing a protective panel over the portal to be protected taken along line 2-2 of FIG. 1.
Figure 3:
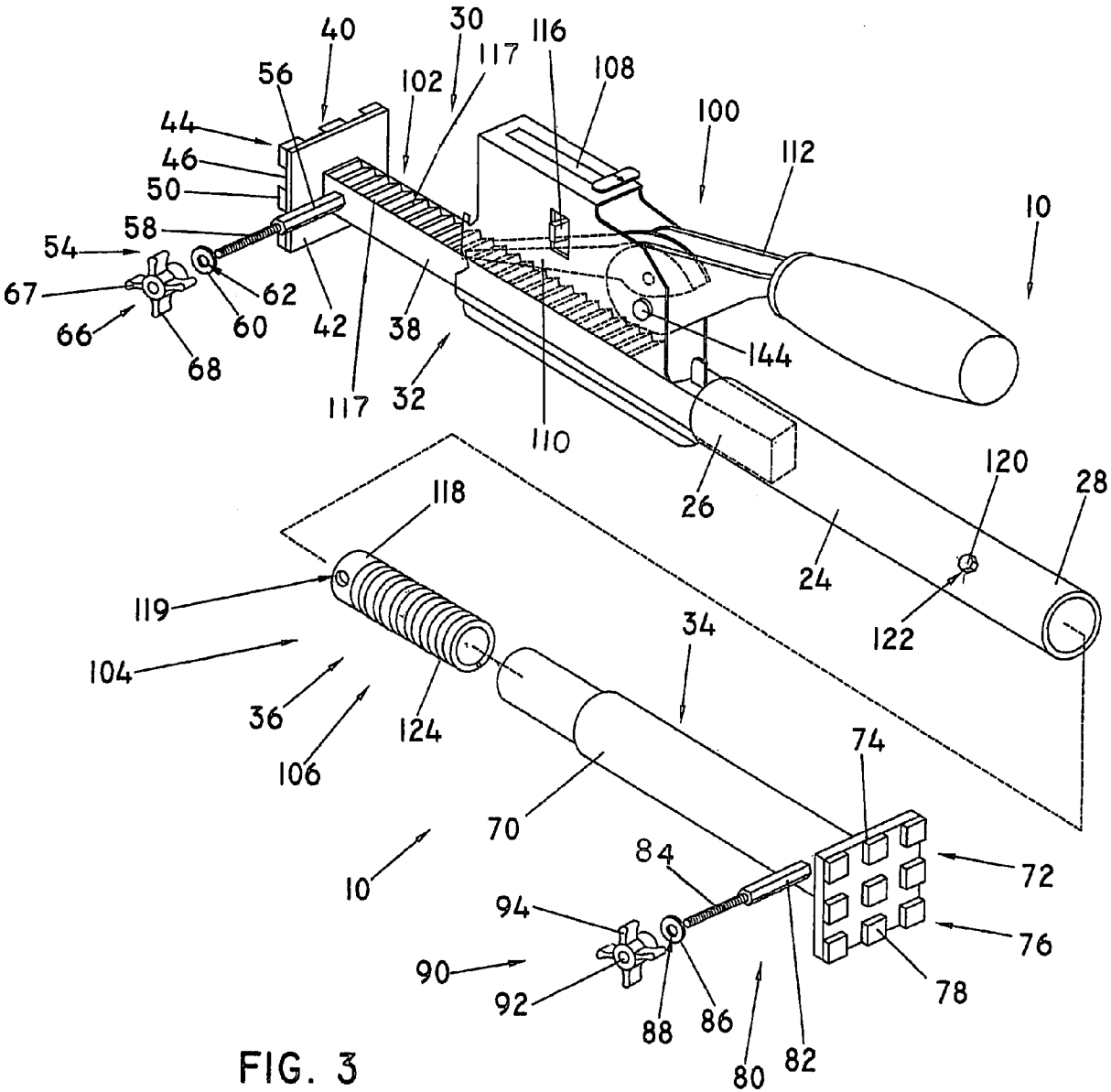
FIG. 3 is an exploded view of the panel mounting system of the present invention.

As shown in FIGS. 1 through 3, the present invention relates to a panel mounting system generally indicated as 10 to secure a protective panel 12 to a building 14 to protect a portal or window generally indicated as 16 of the building 14 when in place.

As best shown in FIGS. 1 and 2, the portal or window 16 comprises a frame including opposite side inner surfaces each indicated as 18 and an upper and lower inner surfaces indicated as 20 and 22 respectively formed about the periphery of the portal or window 16.

As best shown in FIGS. 1 through 3, the panel mounting system 10 comprises an elongated cross-bar 24 including a first end portion 26 and a second end portion 28 formed on opposite ends thereof operatively coupled to a first securing assembly generally indicated as 30 by a first positioning assembly generally indicated as 32 and a second securing assembly generally indicated as 34 by a second positioning assembly generally indicated as 36.

Figure 4:
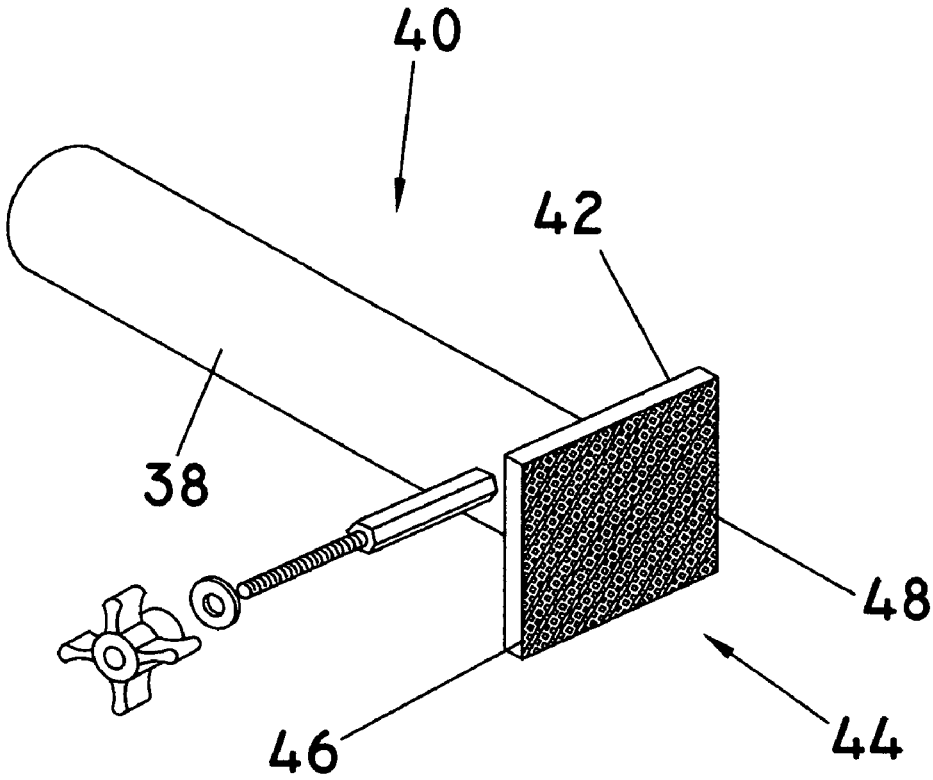
FIG. 4 is a side view of an alternate embodiment of the inner surface engaging pad of the present invention.
Figure 5:
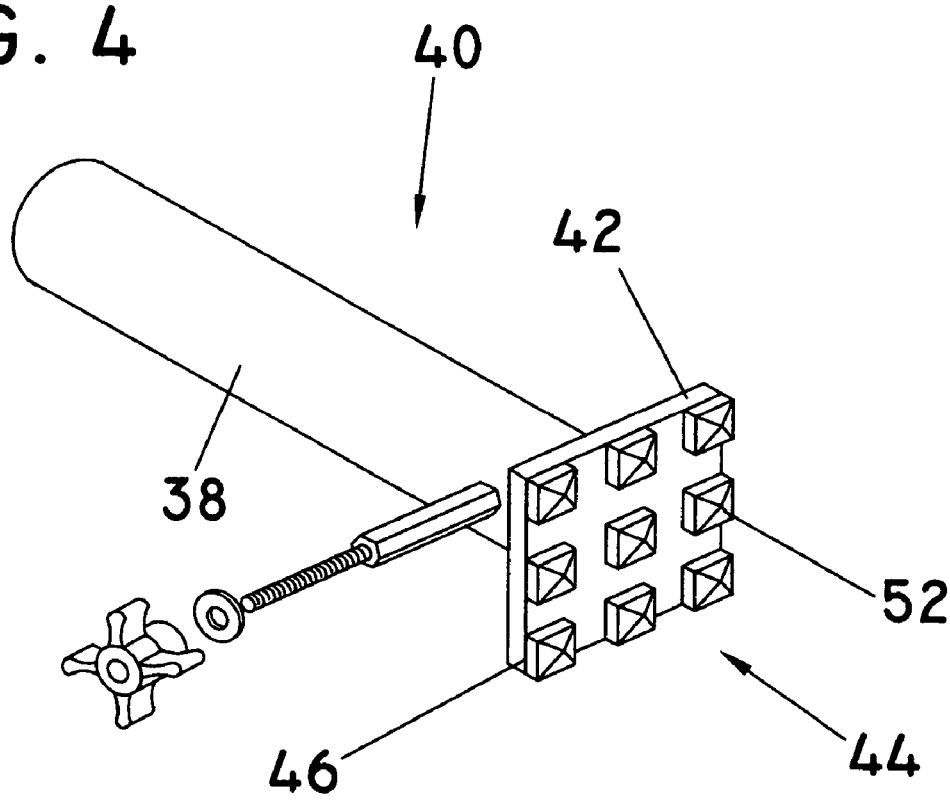
FIG. 5 is a side view of another alternate embodiment of the inner surface engaging pad of the present invention.

As best shown in FIG. 3, the first securing assembly 30 comprises a first telescoping member 38 having a first frame engaging base generally indicated as 40 affixed to the outer end thereof. The first frame engaging base 40 comprises a substantially rigid plate member 42 having an inner surface engaging pad generally indicated as 44 attached to the outer surface 46 thereof. The inner surface engaging pad 44 may comprise a resilient compressible member 48, a plurality of resilient friction protrusions or ridges 50 or a plurality of substantially rigid pin-like elements 52, FIGS. 4, 3 and 5 respectively, to engage the side inner surfaces 18 on opposite sides of the frame or the upper and lower inner surfaces 20 and 22 to press-fit the panel mounting system 10 in position within the frame as described more fully hereinafter. A first panel attachment device generally indicated as 54 secures the protective panel 12 to the first securing assembly 30 as described hereinafter. Specifically, the first panel attachment device 54 comprises an internally threaded post 56 extending substantially perpendicularly outward from the first telescoping member 38 having an externally threaded member 58 extending outwardly therefrom to receive a limit or washer 60 including a centrally disposed aperture 62 to receive the externally threaded pin 58 therethrough and held in contact with the exterior surface 64 of the protective panel 12 by an internally threaded retainer or cap generally indicated as 66 mounted on the externally threaded member 58 having an enlarged outer portion 67 with a plurality of knurls or projections 68 formed thereon to facilitate the tightening and loosening of the internally threaded retainer or cap 66 on the externally threaded member 58. The longitudinal length or distance between the surface of the first telescoping member 38 and the internally threaded retainer or cap 66 is adjustable by moving the externally threaded member 58 relative to the internally threaded post 56.

As best shown in FIG. 3, the second securing assembly 34 comprises a second telescoping member 70 having a second frame engaging base generally indicated as 72 affixed to the outer end thereof. The second frame engaging base 72 comprises a substantially rigid plate member 74 having an inner surface engaging pad generally indicated as 76 attached to the outer surface thereof. The inner surface engaging pad 76 may comprise a resilient compressible member, a plurality of resilient friction protrusions or ridges 78 or a plurality of substantially rigid pin-like elements to engage the side inner surfaces 18 on opposite sides of the frame or the upper and lower inner surfaces 20 and 22 to press-fit the panel mounting system 10 in position within the frame as described more fully hereinafter. A second panel attachment device generally indicated as 80 secures the protective panel 12 to the second securing assembly 34 as described hereinafter. Specifically, the second panel attachment device 80 comprises an internally threaded post 82 extending substantially perpendicularly outward from the second telescoping member 70 having an externally threaded member 84 extending outwardly therefrom to receive a limit or washer 86 including a centrally disposed aperture 88 to receive the externally threaded pin 84 therethrough and held in contact with the exterior surface 64 of the protective panel 12 by an internally threaded retainer or cap generally indicated as 90 mounted on the externally threaded member 84 having an enlarged outer portion 92 with a plurality of knurls or projections 94 formed thereon to facilitate the tightening and loosening of the internally threaded retainer or cap 90 on the externally threaded member 84. The longitudinal length or distance between the surface of the second telescoping member 70 and the internally threaded retainer or cap 90 is adjustable by moving the externally threaded member 84 relative to the internally threaded post 82.

As best shown in FIG. 3, the first positioning assembly 32 comprises a first cross-bar assembly section generally indicated as 100 coupled to the first end portion 26 of the elongated cross-bar 24 and a first securing assembly section generally indicated as 102 disposed to engage each other to selectively move the first positioning assembly 32 between a retracted and an extended position. The second positioning assembly 36 comprises a second cross-bar assembly section generally indicated as 104 coupled to the second end portion 28 of the elongated cross-bar 24 and a second securing assembly section generally indicated as 106 disposed to engage each other to selectively move the second positioning assembly 36 from the extended position to the retracted position when the first positioning assembly 32 is moved from the retracted position to the extended position to secure the panel mounting system 10 to the inner surface 18/18 or 20/22 of the frame.

The first cross-bar assembly section 100 comprises an enclosure 108 to house a ratchet 110 coupled to an actuator or handle 112 movable between a first and second position pivotally mounted on the enclosure 108 by a pivot member 114. The ratchet 110 is selectively movable in a first direction to move the first positioning assembly 32 from the retracted position to the extended position when the ratchet control or pin 116 is in a first position and movable in a second direction to move the first positioning assembly 32 from the extended position to the retracted position when the ratched control or pin 116 is in a second position. The first securing assembly section 102 comprises a plurality of slots, notches, teeth or apertures each indicated as 117 formed on first telescoping member 38 disposed to engage the racket 110 to extend the first securing assembly 30 when the ratchet control or pin 116 is in the first position and the actuator or handle 112 is pivoted about the pivot member 114 and the first securing assembly 30 is retracted when the racket control or pin 116 is in the second position and the actuator or handle 112 is pivoted about the pivot member 114.

The second cross-bar assembly section 104 comprises a substantially cylindrical hollow member 118 having an aperture 119 formed thereon coupled to the second end portion 28 by a coupling member or pin 120 extending through an aperture 122 formed therethrough and the aperture 119 formed in the substantially cylindrical hollow member 118. The second securing assembly section 106 comprises a bias or spring 124 affixed to the substantially cylindrical hollow member 118 and disposed with the elongated cross-bar 24 and the second telescoping member 70 of the second securing assembly 34 such that the second positioning assembly 36 is moved from the extended position to the retracted position when the first positioning assembly 32 is moved from the retracted position to the extended position and wherein the second positioning assembly 36 is moved from the retracted position to the extended position when the first positioning assembly 32 is moved from the extended position to the retracted position. The bias or spring 124 of the second positioning assembly 36 acts against the force of the first positioning assembly 32 as the first positioning assembly 32 is moved from the retracted position to the extended position to prevent damage to the building 14 or frame.

When a pair of panel mounting system 10 as shown in FIG. 1, a protection panel 12 having performed aperture is placed over the portal or window 16 such that the externally threaded members 58 and 84 are passed through the apertures in the protective panel 12. The protective panel 12 is then secured against the surface of the building 14 by the internally threaded retainers or caps 66 and 90.

It will thus be seen that the objects set forth above, among those made apparent from the preceding description are efficiently attained and since certain changes may be made in the above construction without departing from the scope of the invention, it is intended that all matter contained in the above description or shown in the accompanying drawing shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described,

What is claimed is:

1. A panel mounting system to secure a protective panel to a building including a portal or window having a frame including an inner surface formed about the periphery thereof to receive and secure said panel mounting system thereto so that the protective panel covers the portal or window when said panel mounting system is secured in place, said panel mounting system comprising a hollow elongated cross-bar including a first end portion and a second end portion, formed on opposite ends of said hollow elongated cross-bar, a first securing assembly including a first telescoping member at least partially disposed within said first end portion of said hollow elongated cross-bar, said first securing assembly having a first panel attachment device affixed to said first telescoping member and a second securing assembly including a second telescoping member at least partially disposed within said second end portion of said hollow elongated cross-bar, said second securing assembly having a second panel attachment device affixed to said second telescoping member such that said first securing assembly and said second securing assembly securely engage the inner surface of the frame on opposite sides of the portal or window when said first securing assembly is moved from a retracted position to an extended position and said second securing assembly is moved from an extended position to a retracted position, a first positioning assembly including a first cross-bar assembly section coupled to said first end portion of said hollow elongated cross-bar disposed to engage said first telescoping member to selectively move said first telescoping member between said retracted position and said extended position and a second positioning assembly including a biasing member disposed within said second end portion of said hollow elongated cross-bar to engage said second telescoping member to biasing member said second telescoping member in said extended position, said first cross-bar assembly section comprising a ratchet coupled to an actuator movable between a first position and a second position and said first telescoping member including a plurality of teeth formed on said first telescoping member disposed to engage said ratchet to incrementally extend said first telescoping member relative to said hollow elongated cross-bar thereby retracting said second telescoping member relative to said hollow elongated cross-bar compressing said biasing member such that said ratchet is disposed within a groove between adjacent teeth when fully extended relative to said plurality of teeth to fully compress said biasing member as said actuator is repeatedly moved in said first position whereupon release of said actuator said biasing member is fully compressed and forces said ratchet against said first telescoping member to secure said first securing assembly against the inner surface of the window frame on one side of the portal or window and said second securing assembly against the inner surface of the window frame on an opposite side of the portal or window and to incrementally retract said first telescoping member relative to said hollow elongated cross-bar whereby said biasing member extends said second telescoping member relative to said hollow elongated cross-bar when said actuator is repeatedly moved in said second position.

2. The panel mounting system of claim 1 wherein said first securing assembly includes a first frame engaging base affixed to the outer end portion of said first telescoping member and said second securing assembly includes a second frame engaging base affixed to the outer end portion of said second telescoping member.

3. The panel mounting system of claim 2 wherein said first frame engaging base comprises a plate member having an inner surface engaging pad and said second frame engaging base comprises a plate member having an inner surface engaging pad to engage opposite sides of the frame to press-fit said panel mounting system in position within the frame.

4. The panel mounting system of claim 3 wherein each said inner surface engaging pad comprises a resilient compressible member.

5. The panel mounting system of claim 3 wherein each said inner surface engaging pad comprises a plurality of resilient friction protrusions or ridges.

6. The panel mounting system of claim 3 wherein each said inner surface engaging pad comprises a plurality of substantially rigid pin-like elements.

7. The panel mounting system of claim 2 wherein said first panel attachment device secures the protective panel to said first securing assembly and said second panel attachment device secures the protective panel to said second securing assembly.

8. The panel mounting system of claim 7 wherein said first panel attachment device comprises an internally threaded post extending outwardly from said first telescoping member having an externally threaded member extending outwardly from said internally threaded post to receive a limit including a centrally disposed aperture to receive said externally threaded member through said centrally disposed aperture and held in contact with the exterior surface of the protective panel by an internally threaded retainer mounted on said externally threaded member and said second panel attachment device comprises an internally threaded post extending outwardly from said second telescoping member having an externally threaded member extending outwardly from said internally threaded post to receive a limit including a centrally disposed aperture to receive said externally threaded member through said centrally disposed aperture and held in contact with the exterior surface of the protective panel by an internally threaded retainer mounted on said externally threaded member.

9. The panel mounting system of claim 8 wherein each said internally threaded retainer includes an enlarged outer portion with a plurality projections formed on said internally threaded retainer to facilitate the tightening and loosening of said internally threaded retainer on said externally threaded member.

10. The panel mounting system of claim 8 wherein the longitudinal distance between the surface of said first telescoping member and said internally threaded retainer is adjustable by moving said externally threaded member relative to said internally threaded post and the longitudinal distance between the surface of said second telescoping member and the internally threaded retainer is adjustable by moving said externally threaded member relative to said internally threaded post.

11. The panel mounting system of claim 7 wherein said first panel attachment device comprises a post extending outwardly from said telescoping member to engage a retainer on said post to contact the exterior surface of the protective panel to secure the protective panel in place.

12. The panel mounting system of claim 1 wherein said first cross-bar assembly section comprises an enclosure to house said ratchet.

13. The panel mounting system of claim 12 wherein said second cross-bar assembly section comprises a member having an aperture formed on said member coupled to said second end portion by a coupling member extending through an aperture formed through said second end portion and said aperture formed in said member.

* * * * *